United States Patent [19]

Lindell

[11] Patent Number: 4,708,529

[45] Date of Patent: Nov. 24, 1987

[54] METHOD IN THE INSTALLATION OF PILES AND APPARATUS FOR CARRYING OUT THE METHOD

[76] Inventor: Edvin Lindell, Björkhagsvägen 6, 172 35 Sundbyberg, Sweden

[21] Appl. No.: 931,747

[22] PCT Filed: Feb. 13, 1986

[86] PCT No.: PCT/SE86/00059

§ 371 Date: Oct. 24, 1986

§ 102(e) Date: Oct. 24, 1986

[87] PCT Pub. No.: WO86/04941

PCT Pub. Date: Aug. 28, 1986

[30] Foreign Application Priority Data

Feb. 25, 1985 [SE] Sweden ..... 85009165

[51] Int. Cl.[4] ..... E02D 5/56

[52] U.S. Cl. ..... 405/240; 405/233; 405/237

[58] Field of Search ..... 405/231, 233, 237, 238, 405/239, 240, 241, 242, 243

[56] References Cited

U.S. PATENT DOCUMENTS

| | | | |
|---|---|---|---|
| 2,438,729 | 3/1948 | Upson et al. | 405/237 |
| 2,952,131 | 9/1960 | Lyroudias | 405/243 |
| 3,005,315 | 10/1961 | Cobi | 405/237 X |
| 3,164,963 | 1/1965 | Talley et al. | 405/243 |
| 3,206,935 | 9/1965 | Phares | 405/243 X |
| 3,344,611 | 10/1967 | Philo | 405/240 |

FOREIGN PATENT DOCUMENTS 976751 4/1964 Fed. Rep. of Germany ..... 405/237

*Primary Examiner*—Dennis L. Taylor

*Attorney, Agent, or Firm*—Nies, Webner, Kurz & Bergert

[57] ABSTRACT

A method for use when installing piles, in which a pipe (2) or the like is inserted into the ground (1) and a flowing and solidifiable substance (3) is introduced into the ground through the pipe, in order, when solidified, to support a pile, and in which method the solidified substance is subjected to pressure in order to cause the substance to penetrate into the surrounding earth and/or to displace the earth, so as to provide an anchorage for the pile.

The method is mainly characterized in that there is created in the proximity of and at least partially beneath the lower orifice (7) of the pipe (2), this pipe (2) constituting an outer pipe (2), a cavity (6) in which the aforementioned solidifiable substance, preferably concrete, is subjected to pressure with the aid of a raisable and lowerable body (5) which can be caused to protrude into the cavity (6) and which extends beneath the bottom orifice (7) of the outer pipe (2) at least during a given part of the period over which the solidifiable substance is placed under pressure, and is moved forcibly downwards during the pressure period with the aid of a downwardly directed force, in order to displace the solidifiable substance present in the cavity (6).

The invention also relates to an arrangement for carrying out the method.

19 Claims, 13 Drawing Figures

METHOD IN THE INSTALLATION OF PILES AND APPARATUS FOR CARRYING OUT THE METHOD

The present invention relates to a method in pile-installation operations, in which there is placed in the ground a pipe or corresponding element through which a flowing and solidifiable substance is passed, so as to assist in supporting a pile when solidified.

Methods are known to the art in which a pipe is inserted into the ground and in which cement or like solidifiable substance is passed to a cavity located at the lower end of the pipe and forced out into the surrounding ground, by means of a plunger operating in the pipe. These methods can be applied satisfactorily with readily flowing substances such as cement, but not with concrete. When subjected to pressure, readily flowing substances, however, have the tendency to seek and enter channels and cavities present in the ground and consequently the substance does not collect into a unitary mass suitable for supporting the pile.

Methods are also known in which a pipe is inserted into the ground together with devices with which a cavity is dug or otherwise formed in the proximity of the lower end of the pipe, and subsequently filled with cement or corresponding solidifiable substance. Such methods are encumbered with serious disadvantages, such as the high costs involved, the excessive time required to complete a pile-installing operation, and the problems created with regard to the transportation of excavated material to the surface of the ground.

The present invention relates to a method which can be carried out both quickly and readily at low costs, and which is suited to the use of concrete. Among other things, because of its simplicity the method is not encumbered to any great extent with technical problems of the kind encountered with known methods. The method also enables concrete to be caused to penetrate into and/or displace the surrounding earth, so as to provide an anchorage for a pile.

The invention thus relates to a method which can be applied in pile-installing operations, and in which there is inserted into the ground a pipe or corresponding conduit through which a flowing and solidifiable substance is passed, so as to support a pile when the material solidifies; and in which method pressure is exerted on the solidifiable substance so as to cause said substance to penetrate into and/or displace the surrounding earth, in a manner to form an anchorage for a pile The method is mainly characterized by creating a cavity in the proximity of and at least partially beneath the lower orifice of the pipe, which constitutes an outer pipe; by applying pressure to a solidifiable substance of the aforesaid kind, preferably concrete, present in the cavity with the aid of a raisable and lowerable body which protrudes into the cavity and which passes beneath the bottom orifice of the outer pipe during a given part of the time over which said pressure is applied, and which when said pressure is applied is caused to move downwards by means of a downwardly acting force, in order to displace the solidifiable substance present in the cavity.

The invention also relates to an arrangement for use in pile-installing operations, this arrangement comprising a pipe or corresponding element which is intended to be inserted into the ground and through which a flowable and solidifiable substance is intended to be passed, so as to assist in supporting a pile when solidified, and which arrangement further comprises means for generating pressure such as to cause the solidifiable substance to penetrate into the surrounding earth and/or to displace said substance so as to form an anchorage for the pile.

The arrangement is mainly characterized in that there is provided a raisable and lowerable body by means of which the aforesaid solidfiable substance, preferably concrete, present in a cavity created in the vicinity of and at least partially beneath the bottom orifice of the pipe, which constitutes an outer pipe, is placed under pressure, said body, for at least a part of the pressure period over which said pressure is applied, being intended to protrude beneath the bottom orifice of the outer pipe; and in that means are provided in moving said body forcibly downwards during said pressure period, in order to displace the aforesaid solidifiable substance present in said cavity.

The invention will now be described in more detail with reference to a number of embodiments thereof illustrated in the accompanying drawings, in which FIG. 1 illustrates schematically a first embodiment of an arrangement according to the invention, seen from one side and partly in vertical section;

FIG. 2 llustrates schematically a second embodiment of an arrangement according to the invention, seen substantially in accordance with FIG. 1.

Figure 1:
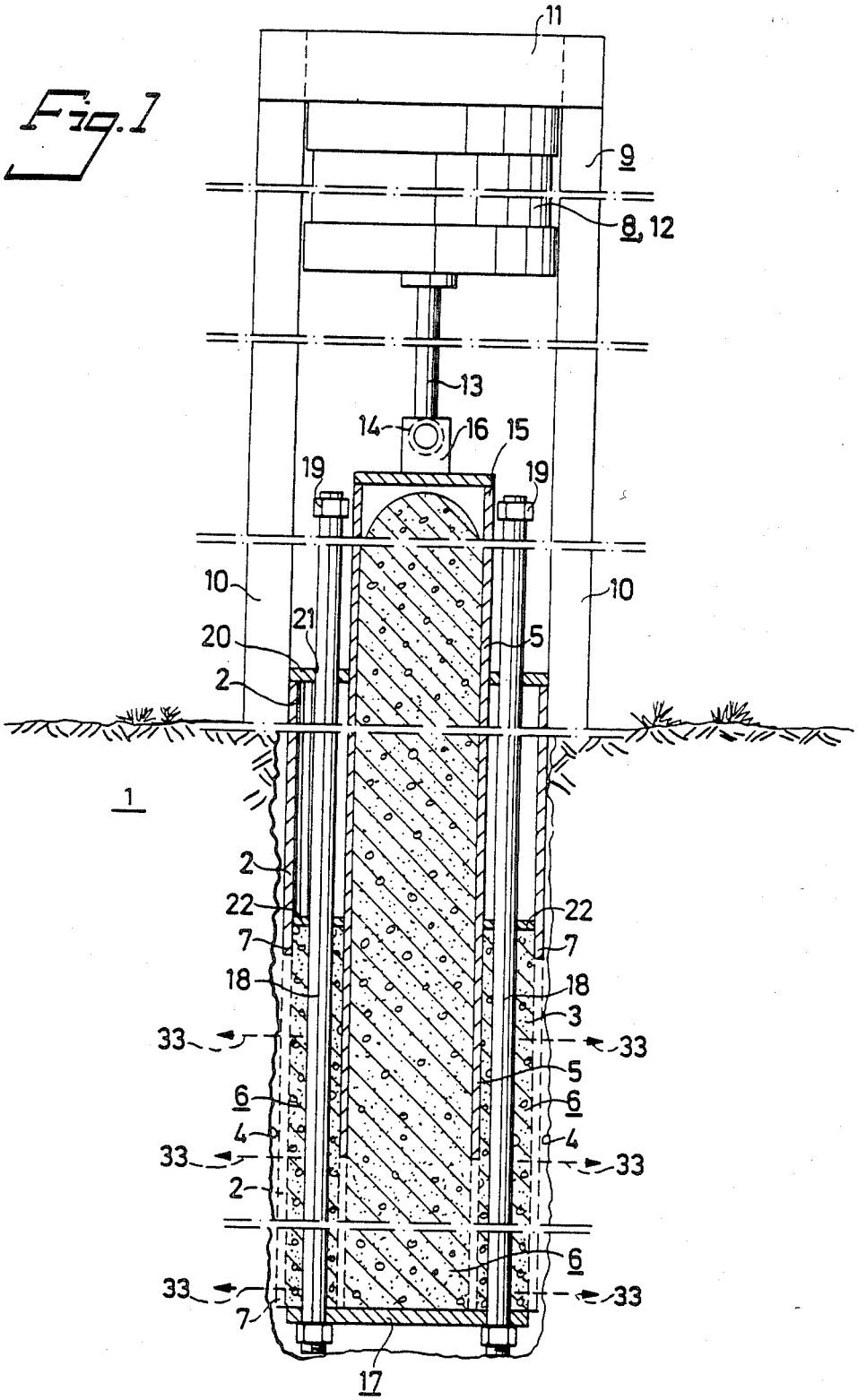

In FIG. 1 the reference 1 designates the ground in which a pile is to be installed and in which an anchorage for assistance in supporting the pile is to be formed. The reference 2 designates a pipe 2 or like element, which constitutes an outer pipe, inserted in the ground 1. The outer pipe 2 is intended to conduct a flowing and solidifiable substance 3, which when set assists in supporting a pile. The pipe 2 can be inserted into a previously drilled hole 4, as illustrated in FIG. 1, or can be driven into the ground.

The reference 5 designates an inner pipe which extends within the outer pipe 2 and which can be raised and lowered, and which thus forms a raisable and lowerable body 5 by means of which the solidfiable substance 3, preferably concrete, present in a cavity 6 created in the proximity of and at least partially beneath the bottom orifice 7 of the outer pipe 2, is placed under pressure, this body, at least during a part of the pressure period, being intended to project beneath the bottom orifice 7 of the outer pipe 2. In this respect, means are provided for moving the body 5 forcibly downwards during the pressure period, with the intention of displacing the solidifiable substance present in the cavity. These means 8 which are preferably hydraulic, are intended to act between the body 5, or force-transmitting means co-acting with said body, and a frame structure or the like connected to the outer pipe 2. The exemplifying embodiment illustrated in FIG. 1 includes a yoke-like frame structure 9 incorporating substantially vertically extending parts 10, which are connected at their respective bottoms to the outer pipe 2 and between which there extends a transverse part 11 which is intended to support and to constitute a holding-up means for at least one substantially vertically acting hydraulic piston-cylinder device 12, having a piston rod 13 whose lower end 14 is connected to the upper end 15 of the body or inner pipe 5, via a force-transmitting attachment 16.

The positions to which the outer pipe 2 and the inner pipe 5 are inserted into the ground are shown in broken lines in FIG. 1. The reference 17 designates a bottom plate or the like which is arranged preferably to substantially cover the bottom orifice 7 of the outer pipe 2 when inserting said pipe, the plate 17 preferably being connected to at least one rod 18, but preferably to several such rods, extending vertically within the circumference of the pipe 2.

The means 8 and the frame-structure 9 constitute means which, subsequent to inserting the outer pipe and the body 5, i.e. the inner pipe, into the ground, are effective in lifting the outer pipe 2, thereby to form at least part of the cavity 6 to be created.

The inner pipe 5 is intended to support against the plate 17 at least during the initial stages of creating the cavity 6, thus primarily when lifting the outer pipe 2 from the lower terminal position shown in broken lines in FIG. 1. The cavity 6 is progressively enlarged, by successively lifting the outer pipe 2, the solidifiable substance also being successively supplied and subjected to pressure. The inner pipe 5 is preferably filled with said substance during this pressure period.

The preferred embodiments of the arrangement according to the invention are provided with limit-position stops or like means which define the maximum extent to which the outer pipe can be lifted. According to one embodiment, the limit-position stop 19 is connected to at least one rod 18, which in turn is connected to the bottom plate and extends vertically therefrom, the limit-position stop 19 of this embodiment comprising, for example, nuts 19 fitted to the upper part of the rod, said rods constituting in this embodiment an anchorage connected to the plate 17. In the embodiment illustrated in FIG. 1, the limit-position stop 19, i.e. the nuts 19, co-act with a stop plate 20 located on the upper part of the pipe 2, said stop plate having provided therein a hole 21 for passage of respective rods 18 through said plate. The pipe 2 also passes through the stop plate 20, which covers the upper end of the pipe 2.

The reference 22 designates a seal located between the outer pipe 2 and the inner pipe 5 and effective to prevent undesirable flow of the solidifiable substance supplied to the cavity 6. The primary function of the seal 22 is to prevent solidifiable substance from flowing back up between the outer and the inner pipes to an undesirable extent.

In the embodiment illustrated in FIG. 1, the solidifiable substance is intended to be supplied to the cavity 6 through the inner pipe 5, to which end at least one inlet opening (not shown) is provided, preferably in the upper part of the pipe 5. Suitably, there is also provided a non-return valve or like device (not shown) for preventing undesirable return flow of the solidifiable substance supplied to the cavity 6.

Figure 2:
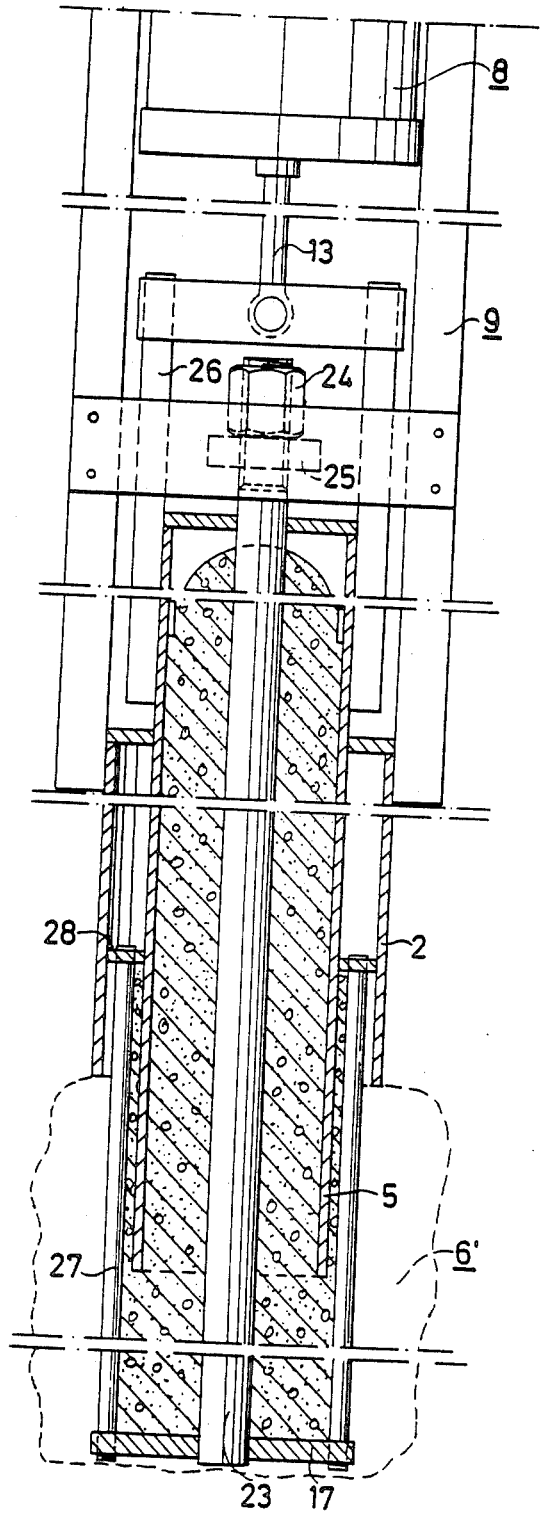

In the arrangement illustrated in FIG. 2, said arrangement coinciding essentially with the FIG. 1 embodiment, there is provided a central rod 23, which extends up through the pipe 5 and is connected to the bottom plate 17, and which is provided on its upper part with a stop nut or like device, which co-acts with the stop plate 25 arranged in the frame structure 9, so as to provide a terminal stop for the pipe 2, therewith limiting the extent to which the pipe 2 can be lifted. The arrangement also includes force-transmission means in the form of a yoke-like element 26 connected to the upper part of the pipe 5 and the piston rod 13 of the hydraulic piston-cylinder device 8. The reference 27 designated rods which are connected to the plate 17 and which carry at least one seal 28, intended to seal between the outer pipe 2 and inner pipe 5.

The ground 1 and the hole 4 formed therein and receiving the downwardly extending pipes 2 and 5 have not been shown in FIGS. 2–9.

Figure 3:
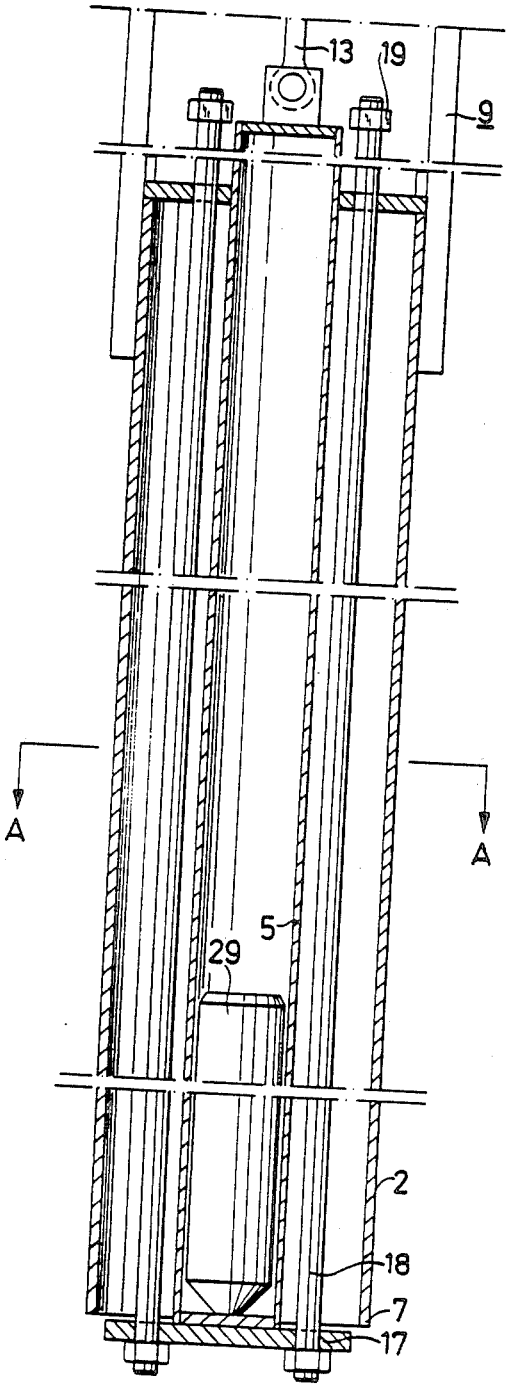
FIG. 3 illustrates schematically a third embodiment of the invention seen substantially in accordance with FIG. 1.
Figure 4:
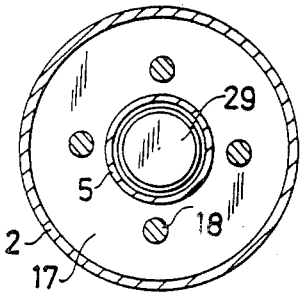
FIG. 4 is a sectional view taken on the line A—A in FIG. 3.
Figure 5:
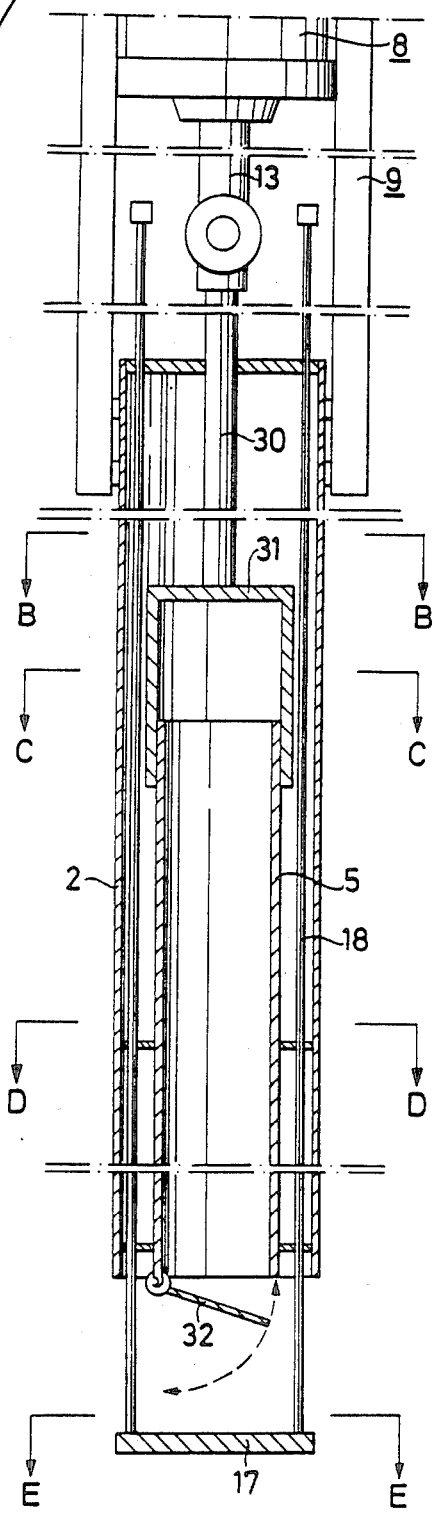
FIG. 5 illustrates schematically a fourth embodiment of an arrangement according to the invention seen substantially in accordance with FIG. 1.
Figure 6:
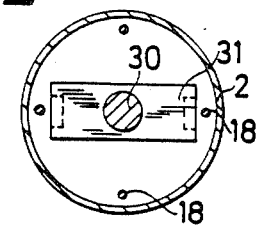
FIGS. 6–9 are sectional views taken on the lines B—B, C—C, D—D E—E respectively in FIG. 5.
Figure 7:
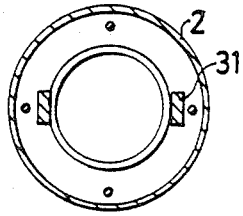
Figure 8:
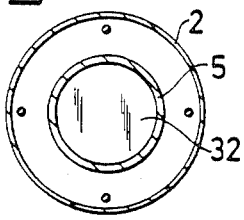
Figure 9:
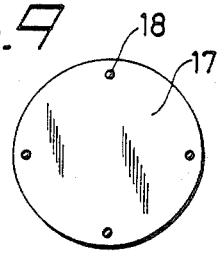
Figure 10:
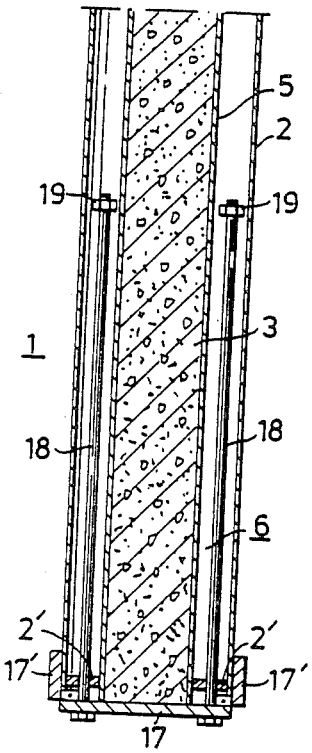
FIGS. 10–13 illustrate a lower part of a fifth embodiment of an arrangement according to the invention, and show four different stages in the supply of concrete to the cavity.
Figure 11:
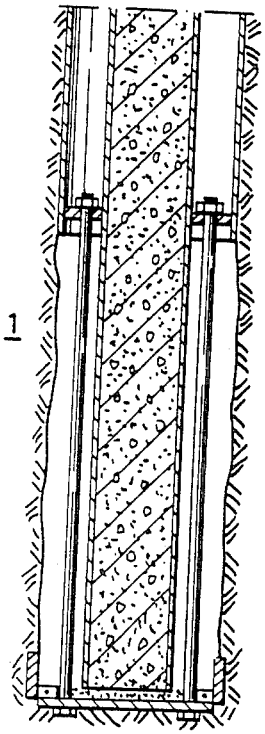
Figure 12:
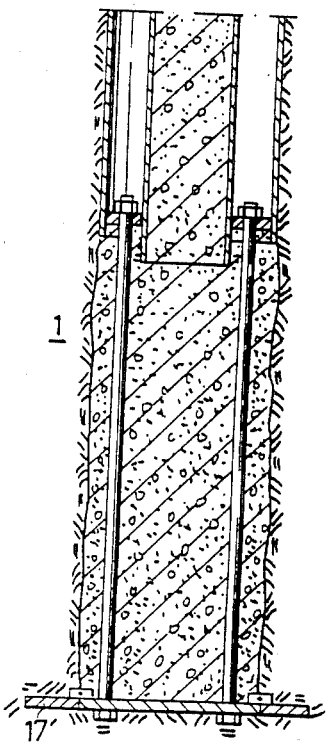
Figure 13:
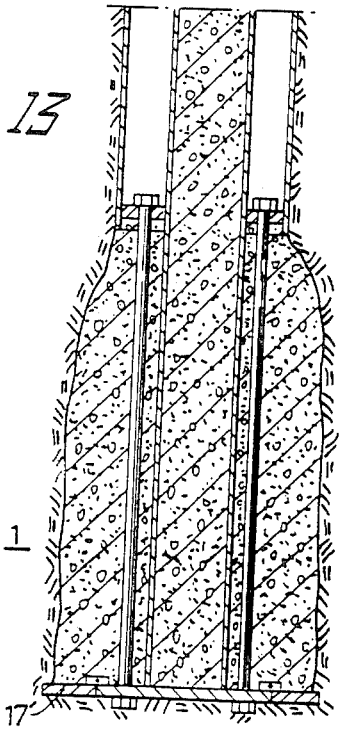

The main difference between the embodiments illustrated in FIGS. 3 and 4 and those illustrated in FIGS. 1 and 2 is that in the former case the solidifiable substance is intended to be supplied to the cavity 6 through the space located between the outer pipe 2 and the inner pipe 5, at least one inlet opening (not shown) being provided, preferably at the upper part of the outer pipe 2. The inner pipe 5 preferably has arranged at its lower end means 29 for vibrating the solidifiable substance, preferably in the cavity 6.

The embodiments illustrated in FIGS. 5–9 include force-transmitting means in the form of a rod 30 and an attachment means 31, which in the illustrated embodiments has the form of a yoke-like element, extending into the pipe 2 and connected to the inner pipe 5 and the piston rod 13. The reference 32 designates a non-return valve located at the bottom orifice of the outer pipe 2 and comprising a plate 32 or like element pivotally mounted at the bottom orifice of the pipe, so as to enable said plate to be swung towards and away from said orifice, in order to close and open the same. The non-return valve is suitably spring-biased, so that the valve will open when solidifiable substance is brought into contact therewith from above, and closes in the absence of said substance, i.e. when pressure is to be exerted on the solidifiable substance present in the cavity 6 with the aid of said body formed by the pipe 5.

In the embodiments illustrated in FIGS. 10–13, rods 18 extend to a given height above the bottom plate 17 and are arranged to co-act with stop shoulders 2' in the pipe 2, through the agency of limit-position stops 19, therewith to limit the extent to which the pipe 2 can be lifted. The reference 17' designates brake-fins or like elements on the bottom plate 17, these brake-fins being arranged to be held upwardly lifted when downwardly inserting the pipe 2, and to be dropped automatically to a respective braking position when the bottom plate is lifted slightly.

The method in which the arrangement according to the invention operates will be apparent in all essentials from the aforegoing.

Thus, the outer pipe 2, suitably containing the aforesaid body or inner pipe 5, is inserted into the ground with the bottom orifice of the pipe covered by the plate 17. With the pipe 5 supported against the plate 17, the hydraulic devices located between the upper part of the inner pipe 5 and the frame structure are expanded so as to lift the outer pipe 2. In doing so, a cavity is created in the proximity of and at least partially beneath the lower pipe-orifice 7, at least a part of which borders upon the vertical wall of the hole 4. The inner pipe 5 is then lifted through a given distance and solidifiable substance, preferably concrete, is introduced into the cavity 6, whereafter the body 5 is forced down in a manner to displace the solidifiable substance and cause said substance to enter into and/or displace the earth located in the vicinity of the cavity 6, as illustrated by the broken lines 33 in FIG. 1 and the cavity 6' shown in broken in FIG. 2. The pipe 5 is also herewith filled at its lower end with solidifiable substance, so as to obtain a body effective to displace solidifiable substance present in the cavity 6. In the embodiment illustrated in FIG. 5, a suitable body is obtained by closing the valve 32. When the force at which the body 5 is forced downwards reaches a value which corresponds to the force required to further lift the outer pipe 2, the pipe 2 is correspondingly lifted so as to further develop the cavity 6. Further solidifiable substance can then be introduced into the cavity and placed under pressure by the body 5. In this way, the pipe 2 is lifted successively to an upper limit position defined by the aforesaid limit-position stop. When this position is reached, a powerful force can be applied so as to displace the solidifiable substance and cause it to penetrate into and/or displace the surrounding earth.

FIGS. 10–13 illustrate a number of different stages in the creation of a pile-anchorage in the cavity 6. It will be understood that the method can be applied so that the pipe 2 is lifted to the terminal position defined by the limit-position stop 19, FIG. 11, at the very first time of lifting the pipe, whereafter said solidifiable substance is successively supplied and pressurized so as to penetrate the surrounding earth, FIG. 13.

Subsequent to forming a pile-anchorage in the ground in the aforesaid manner, the body, i.e. the pipe 5, may optionally be left in the ground, together with any rod or rods 18,23 present, and solidified substance, to provide a stable pile. If considered suitable, the pipe 2 can also be left in the ground. The anchorage can, of course, be utilized with a pile which does not comprise one or both of the pipes 2 and 5.

It will also be apparent from the aforegoing that the invention provides a particularly simple and purposeful method and arrangement. An essential feature is the insertion of said body into the solidifiable substance present in the cavity 6. This provides excellent possibilities of displacing said substance and therewith causing the same to penetrate into and/or displace the earth surrounding the cavity. The solidifiable substance used in accordance with the invention is preferably concrete, thereby avoiding problems due to caviation.

Although the invention has been described in the aforegoing with reference to a number of embodiments thereof, it will be understood that further embodiments and minor modifications are conceivable without departing from the scope of the invention.

For example, devices other than hydraulic devices may be used to generate the aforesaid vertically acting force, such as mechanical and pneumatic devices.

In addition, the frame structure may be anchored, for example, in the ground in some suitable manner, in order to limit upward movement.

Embodiments are also conveivable in which solidifiable substance is supplied both through the body, or inner pipe 5, and through the gap located between the outer pipe 2 and said body.

It will also be understood that the outer pipe 2 and the body 5, i.e. the inner pipe, need not have a circular cross-sectional shape, but may, for example, have a square cross-sectional shape.

Limit-position stops, sealing devices and non-return valves may, of course, be arranged in a number of ways. For example, a non-return valve may be provided in the vicinity of the upper part of the pipe 5, in the vicinity where solidifiable substance is supplied to the pipe.

Variants are conceivable in which movable limit-position stops are provided, such as to enable upward movement of the pipe 2 to be limited by said stop at several levels in the vertical direction, i.e. at several locations during the successive lifting of the pipe 2.

The arrangement may also be supplemented with cleansing means, operating with water under pressure for example, optionally mainly in connection with component parts where solidified substance is supplied to the cavity 6. Such cleansing eliminates the formation of obstructive plugs of solidifiable substance.

The invention is thus not restricted to the described and illustrated embodiments and modifications can be made within the scope of the following claims.

With regard to the choice of construction materials used, primarily with respect to the outer pipe 2, this pipe may be made of steel, although concrete or some other suitable material may be used.

I claim:

1. A method in the installation of piles, in which a pipe or like element is inserted into the ground, and through which pipe a flowing and solidifiable substance is introduced down into the ground so as to assist in supporting a pile when solidified, and in which said solidifiable substance is subjected to pressure in order to cause said substance to penetrate into the surrounding earth and/or displace the same, such as to create an anchorage for the pile, characterized by creating a cavity (6) in the proximity of and at least partially beneath the lower orifice (7) of the pipe (2), which pipe (2) constitutes an outer pipe (2); by applying pressure to a solidifiable substance of the aforesaid kind, preferably concrete, present in the cavity (6) by means of a raisable and lowerable body (5), which protrudes into the cavity and which passes beneath the bottom orifice (7) of the outer pipe (2) at least during a given part of the time over which said pressure is applied and which, when said pressure is applied, is moved forcibly downwards by means of a downwardly acting force in order to displace solidifiable substance present in the cavity (6).

2. A method according to claim 1, characterized in that said body (5) comprises an inner pipe (5) arranged in the outer pipe (2), said inner pipe (5) being preferably filled with solidifiable substance during the period over which pressure is applied.

3. A method according to claim 1, characterized in that at least part of said cavity (6) is created by lifting the outer pipe (2), subsequent to inserting the outer pipe (2) and said body (5); and in that said cavity (6) is progressively increased in size by successively lifting the outer pipe (2), the solidifiable substance being successively supplied to said cavity and subjected to pressure.

4. A method according to claim 1, characterized in that said body (5) is displaced by means of preferably hydraulic devices acting between the body (5) or force-transmitting means (16,26,30,31) co-acting with the body (5) and a frame structure (9) or the like connected to the outer pipe (2).

5. A method according to claim 3, characterized by providing limit-position stops (19,24) or the like at locations corresponding to an uppermost position to which the outer pipe (2) is lifted.

6. A method according to claim 1, characterized by covering, preferably substantially, the bottom orifice (7) of the outer pipe (2) with a bottom plate (17) or the like when inserting said pipe, said plate (17) being preferably connected to at least one upwardly extending rod (18,23) or the like; and in that said body (5) is supported by the bottom plate (17) at least during the initial stages of forming said cavity (6).

7. A method according to claim 6, characterized in that said limit-position stop (19,24) is connected with at least one upwardly extending rod (18,23) connected to the bottom plate (17).

8. A method according to claim 1, characterized by providing at least one non-return valve (32), a seal (22,28) or the like for preventing undesirable flow of solidifiable substance present in the cavity (6) during the pressure period.

9. A method according to claim 1, characterized by supplying said solidifiable substance to said cavity (6) through the body (5) and/or through the space presented between the body (5) and the outer pipe (2).

10. An arrangement for use when installing piles, comprising a pipe or the like which is intended to be inserted into the ground and through which a flowing and solidifiable substance is introduced into the ground in order to assist, when solidified, in supporting a pile, and in which arrangement means are provided for generating pressure intended to cause said solidifiable substance to penetrate into the surrounding earth and/or displace said earth so as to form an anchorage for said pile, characterized in that the arrangement further comprises a raisable and lowerable body (5) effective to exert pressure on solidifiable substance, preferably concrete, present in a cavity (6) created in the vicinity of and at least partly beneath the bottom orifice (7) of said pipe (2), said pipe (2) constituting an outer pipe (2), said body (5) being intended to extend beneath the bottom orifice (7) of the outer pipe (2) at least during a given part of said pressure period, and in that means (8) are provided for displacing said body (5) forcibly downwards during said pressure period by means of a downwardly acting force, in order to displace the solidifiable substance present in the cavity (6).

11. An arrangement according to claim 10, characterized in that said body (5) comprises an inner pipe (5) arranged at least partially in the outer pipe (2), said inner pipe (5) preferably being filled with solidifiable substance during said pressure period.

12. An arrangement according to claim 10, characterized in that means (8,9) are provided for lifting the outer pipe (2), subsequent to inserting the outer pipe (2) and said body (5) into the ground, such as to form at least part of said cavity (6); and in that said cavity (6) is progressively increased in size by successive withdrawal of the outer pipe (2), solidifiable substance being successively introduced into said cavity and subjected to pressure therein.

13. An arrangement according to claim 10, characterized in that means (8), preferably hydraulic means, are provided to effect the aforesaid movement of said body (5), these means being intended to act between the body (5) or force-transmitting means (16,26,30,31) co-acting with said body and a frame-structure (9) or the like connected to the outer pipe (2).

14. An arrangement according to claim 12, characterized in that the arrangement further includes limit-position stops (19,24) or like elements corresponding to an uppermost position of the outer pipe (2), such as to limit the extent to which the outer pipe (2) can be lifted.

15. An arrangement according to claim 10, characterized in that the arrangement further includes a bottom plate (17) or the like effective to preferably substantially cover the bottom orifice of the outer pipe (2) when inserting said outer pipe (2) into the ground, said plate (17) being preferably connected to at least one outwardly extending rod (18,23) or the like, said body (5) being supported against the plate (17) at least during the initial stages of creating said cavity (6).

16. An arrangement according to claim 14, characterized in that the limit-position stop (19,24) is connected to at least one upwardly extending rod (18,23) connected to the bottom plate (17).

17. An arrangement according to claim 14, characterized in that the arrangement further comprises at least one non-return valve (32), sealing means (22,28) or the like effective to prevent undesirable flow, such as backflow, of said solidifiable substance introduced into the cavity (6).

18. An arrangement according to claim 10, characterized in that said solidifiable substance is intended to be introduced into the cavity (6) through the body (5) and/or through the space defined by the body (5) and the outer pipe (2).

19. An arrangement according to claim 10, characterized in that the arrangement further includes a yoke-like frame structure (9) comprising substantially vertically extending parts (10) which are connected at the bottom thereof to the outer pipe (2) and between which there extends a transverse part (11) which supports and constitutes a holding-up means for at least one substantially vertically acting hydraulic piston-cylinder device (12) having a piston rod (13) whose lower end (14) is connected to said body (5) or to force-transmitting means (16,26,30,31) co-acting with said body; and in that a bottom plate (17) is arranged beneath the bottom orifice (7) of the outer pipe (2); and in that at least one rod (18,23) extends upwardly from the bottom plate (17) to a position preferably located above the surface of the ground, at least one rod (18,23) having provided at its upper part limit-position stops (19,24) intended to co-act with means (20,25) located in the vicinity of the upper part of the outer pipe (2), so as to limit vertical upward movement of the outer pipe (2) by means of said limit-position stop and said means.

* * * * *